United States Patent [19]

Hospers et al.

[11] 4,378,725

[45] Apr. 5, 1983

[54] METHOD OF MANUFACTURING SEALED ROPE AND KNOTTED NETTING FROM SUCH ROPE

[75] Inventors: Johannes Hospers, Ijssel; Gerhard ten Lohuis, Apeldoorn, both of Netherlands

[73] Assignee: Anza B.V., Apeldoorn, Netherlands

[21] Appl. No.: 208,577

[22] Filed: Nov. 20, 1980

[30] Foreign Application Priority Data

Nov. 22, 1979 [NL] Netherlands ..... 7908515

[51] Int. Cl.[3] ..... D04C 1/12; D02G 3/04; D02G 3/40; D07B 1/04

[52] U.S. Cl. ..... 87/12; 57/7; 57/234; 57/251; 57/297; 87/1; 87/6; 156/148; 156/166; 156/180; 156/296

[58] Field of Search ..... 87/1, 6, 12; 57/234, 57/242, 251, 295, 297, 7, 210; 156/148, 161, 166, 180, 296

[56] References Cited

U.S. PATENT DOCUMENTS

| | | | |
|---|---|---|---|
| 2,262,861 | 11/1941 | Rugeley | 57/210 X |
| 2,284,728 | 6/1942 | Dreyfus | 87/1 |
| 3,425,207 | 2/1969 | Campbell | 57/7 X |
| 4,275,117 | 6/1981 | Crandall | 156/296 X |

FOREIGN PATENT DOCUMENTS

| | | |
|---|---|---|
| 822590 | 11/1951 | Fed. Rep. of Germany . |
| 1015409 | 9/1957 | Fed. Rep. of Germany . |
| 1073677 | 1/1960 | Fed. Rep. of Germany . |
| 2210259 | 9/1973 | Fed. Rep. of Germany . |
| 572420 | 6/1924 | France . |
| 1511059 | 1/1968 | France . |
| 1250397 | 11/1968 | France . |
| 96490 | 8/1960 | Netherlands . |
| 7201188 | 8/1972 | Netherlands . |
| 7904033 | 11/1979 | Netherlands . |
| 552225 | 3/1943 | United Kingdom . |
| 579662 | 8/1946 | United Kingdom . |
| 791336 | 2/1958 | United Kingdom . |
| 886740 | 1/1962 | United Kingdom . |
| 900769 | 7/1962 | United Kingdom . |

*Primary Examiner*—John Petrakes

*Attorney, Agent, or Firm*—Finnegan, Henderson, Farabow, Garrett & Dunner

[57] ABSTRACT

A method for producing a sealed rope of braided or twisted filaments. Heat-shrinkable filaments are braided or twisted about a core of a thermoplastic material to form a rope and the rope is placed under tension and treated to cause the thermoplastic core material to melt. Simultaneously the rope is maintained at a temperature sufficient to cause the heat-shrinkable filaments to shrink but not to melt, whereby the shrinking of the filaments, while the rope is under tension, reduces the cross section of the rope and causes the material to penetrate into the openings between and to surround and seal the filaments of the rope.

9 Claims, 5 Drawing Figures

METHOD OF MANUFACTURING SEALED ROPE AND KNOTTED NETTING FROM SUCH ROPE

This invention relates to a method of manufacturing braided cord, twine or twisted ropes and more particularly, to a method of manufacturing a net of said materials, in particular a net destined for fishing purposes.

The invention relates generally to the manufacture of braided cord, twine or twisted rope in which the openings between the filaments of the base material of the cord or rope are sealed and in which the braiding, twining or twisting is carried out about a core of thermoplastic material. The product thus obtained is subjected to a treatment that causes the thermoplastic core material to soften or melt and penetrate into the openings between the threads or filaments of the cord or rope.

The manufacture of a braided cord, twine and rope is generally known and the outer sealing of such a product by applying a coating to the outside thereof is also known. Further, from U.S. Pat. No. 2,284,728 it is known to use a core of thermoplastic material. This material after it is softened penetrates into the spaces between the filaments or yarns by pressure applied upon the outer side of the cord, twine or rope.

An outer coating as a seal has the draw back that it may locally disappear by wear and tear, such a disappearance being detrimental not only as regards the appearance of the cord, twine or rope but also as regards the properties thereof because a path is created thereby for the penetration of undesirable substances, such as dirt, sand and other substances capable of deteriorating the performance characteristics of the cord or rope by affecting its flexibibility, strength and dimensional stability.

Furthermore, by using pressure applied to the outside of a cord containing a thermoplastic core to soften it, does not guarantee an even distribution of the softened core material, and consequently the binding of the fibers with the core is not uniform.

An object of the invention therefore is to provide a solution for these problems. This object is achieved in accordance with the invention by treating the product obtained by braiding, twining or twisting to soften or melt the thermoplastic core while holding the cord under tension.

If the cord, twine or rope provided with a thermoplastic core is kept under tension the diameter thereof will become smaller. If now, simultaneously, the core is softened or caused to melt by the addition of a softening agent or by a heat treatment, respectively, and because the cord tightly surrounds the core due to the tension imparted to it the core material will penetrate from the interior into the openings between the fibers of the cord and will also to form a seal not subject to abrasion from the outer surface. The pressure of the base material against the core is effective over its entire tensioned length.

The invention relates more particularly to a method of manufacturing a knotted netting of braided cord, twined yarn or twisted rope made of a shrinkable material and, in particular a thermoplastic fiber material said. The netting is made by interknotting the cords to form a reticulated network and thereupon subjecting said recticulated network in tensioned condition to a heat treatment and sealing of the openings between the filaments of the base material. It is known in general to manufacture a netting, for instance a fishing net in this way. As the base material therefore there are used yarns known to have a high strength and a high resistance to wear and tear such as polyamide yarns, in particular nylon 6 yarns. Preferably a hollow cord is braided, from these yarns because such a hollow cord is flexible and allows an easy knotting. A network obtained in this way is then subjected usually to a heat treatment while either being kept or not in tensioned condition in order to fix the knots and to stabilize the material, such meaning that the material is caused to shrink. In this way there is obtained a netting having meshes of the same size everywhere and having well fixed knots.

When using such a netting as a fishing net foreign matter such as sand may be deposited within the voids of the cords forming the netting, such being true in particular when using the net as a drag net. The grains of sand will positively penetrate into the sheath or construction of the cords but will not leave these parts thus causing a swelling of the cord parts and consequently causing longitudinal changes whereby deviations in the mesh width will occur.

Moreover the grains of sand in the interior of the cords are conducive to a rapid abrasion because the net is subject to continous movements so that the fibers of the netting and the grains of sand will be continuously in frictional movement with respect to each other.

For avoiding these drawbacks, it is true, that it is known to coat the netting after the manufacture thereof with a coating envisaged to seal the openings between the fibers from the outside. A colorant may be added to this coating.

However, this coating will wear away whereupon sand may again penetrate and cause the aforesaid objections. Moreover the coating will be worn way more rapidly at the location of the knots forming thickened portions for that matter which in case of a coating provided with a colorant will lead to differences in colour whereby the efficiency in fishing may be detrimentally affected. It is true some fishes like tuna cannot observe colours but they do observe colour differences whereby the originally not-visible net will become visible for such fish causing them to flee.

A further object of the invention is therefore to provide a method of manufacturing a knotted netting that does not have the aforesaid drawbacks anymore.

This object is attained in accordance with the invention in that there is utilized a braided cord, twine or rope provided with a core of thermoplastic material, said cord, twine or rope being knotted to form a reticulated network before the network is placed under and treated to cause a softening of the core and a shrinkage of the fibers of the base material. The knotted reticulated network is tensioned on all sides and subjected to the heat treatment while being kept in the tensioned condition during the heat treatment, said heat treatment being such that during the shrinkage of the base material of the cords the thermoplastic material of the core will penetrate from the interior into the openings between the filaments and threads of the base material.

The cord, twine or rope, braided, twined or twisted, respectively, about the, core and before being subjected to the further treatement causing the core material to penetrate to the outside, still possesses the flexibility necessary to make the knots in the reticulated network. When after the formation of the reticulated construction by knotting, this network is subjected to a heat treatment causing the fibers to shrink and also causing the core to melt and provided the network is kept from all sides intensioned condition, the shrinkage will result in an increase in the tension whereby the parts of the net work between the knots will assume a smaller diameter and consequently more forcefully enclose the core and cause it to penetrate further the openings between the filaments and threads of for instance the braid to the outside. The shrinkage stress thus acquired will simultaneously cause the knots to be tightened more strongly so that the core material will also penetrate to the outside at said knots. Such a movement of the core material from the interior to the outside provides for the incasement of the filaments and a sealing of the openings between the threads. The resulting construction is subject to wear and tear in a much lesser degree and prevents the penetration of sand. When the core is provided with a colorant the described method will yield a coloured netting which will not be subject to differences in colour upon abrasion at the location of the knots.

It is of importance that the shrinkage of the material and the softening and melting of the core occur simultaneously for otherwise zones insufficiently sealed by the core material might yet be formed close to the knots.

The core is comprised of a supporting fiber capable of withstanding the temperatures and forces occurring during the manufacturing process coated with a thermoplastic material. Preferably a similar type of material as the base material of the cord will be used as the supporting fiber that it also will be capable of withstanding the temperatures and forces applied during the heat treatment. Preferably there will be used a polyamide or polyester thread coated with a thermoplastic material such as a polymer of polyethylene. The material that has to be capable of melting and penetrating into the voids of the cords during the shrinkage treatment is then supplied by the thermoplastic material, whereas the inner thread of polyamide or polyester may then loose its supporting function. T his supporting function is desired in order to assure that molten core material does not flow away to one side which might result in an uneven sealing.

In the manufacture of a netting it is known to fix the knots by means of a heat treatment. In accordance with the invention this heat treatment is now preferably applied at a temperature above the shrinkage temperature of the base material of the cords. In this way it is achieved that the fixation of the knots will only occur when also the material in the knots has had the opportunity to tighten well around the molten core material during the shrinkage operation.

The invention will now be described in further in detail with reference to the drawings, in which FIG. 1 represents a piece of braided cord according to the invention;

Figure 3:
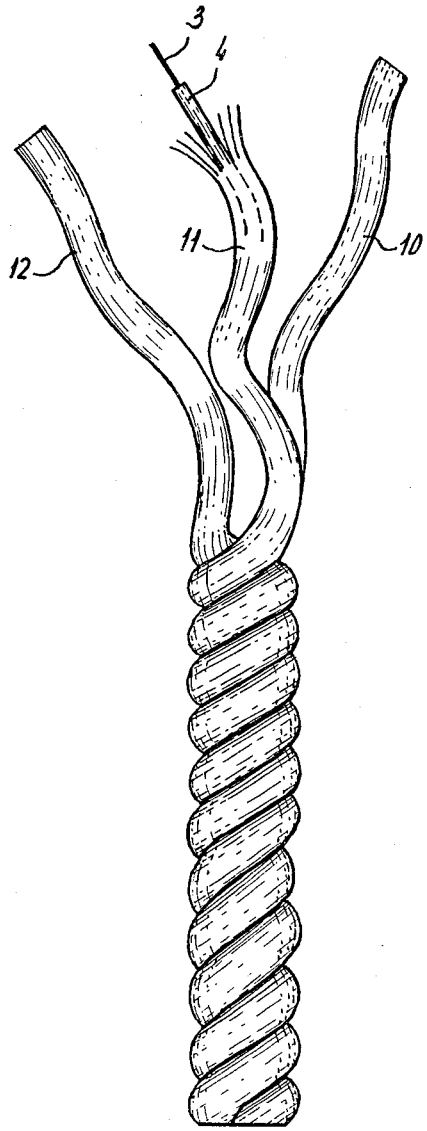
FIG. 3 shows a piece of twine or rope of several filament bundles provided with a core thread.
Figure 3A:
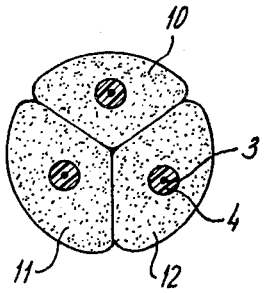

FIG. 3*a* is a cross section of FIG. 3 and

Figure 4:
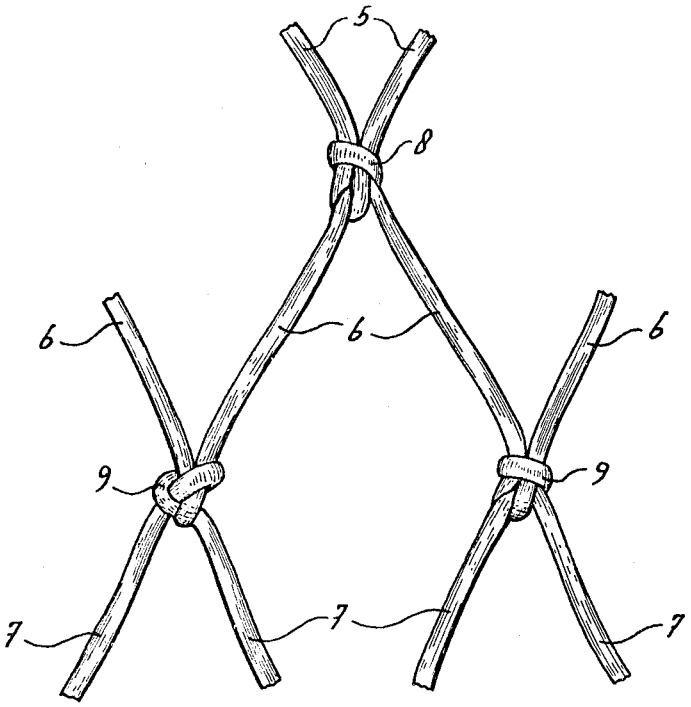

FIG. 4 shows part of a reticulated net.

Figure 1:
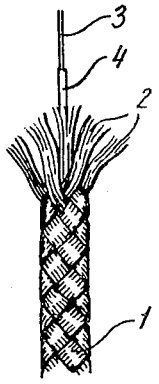

With reference to FIG. 1 there is shown a braid 1 composed of flat filament bundles like indicated at 2, said braid 1 being braided about a core consisting of an inner thread 3, for instance made of polyamide, coated with a layer of thermoplastic material 4.

It is not possible to show in the drawing that after treatment according to the invention the coating layer 4 penetrates between the filament and the openings of the braid whereby the braid has become coherent and solid and would likewise be completely coloured when utilizing a colorant in the coating 4.

Figure 2:
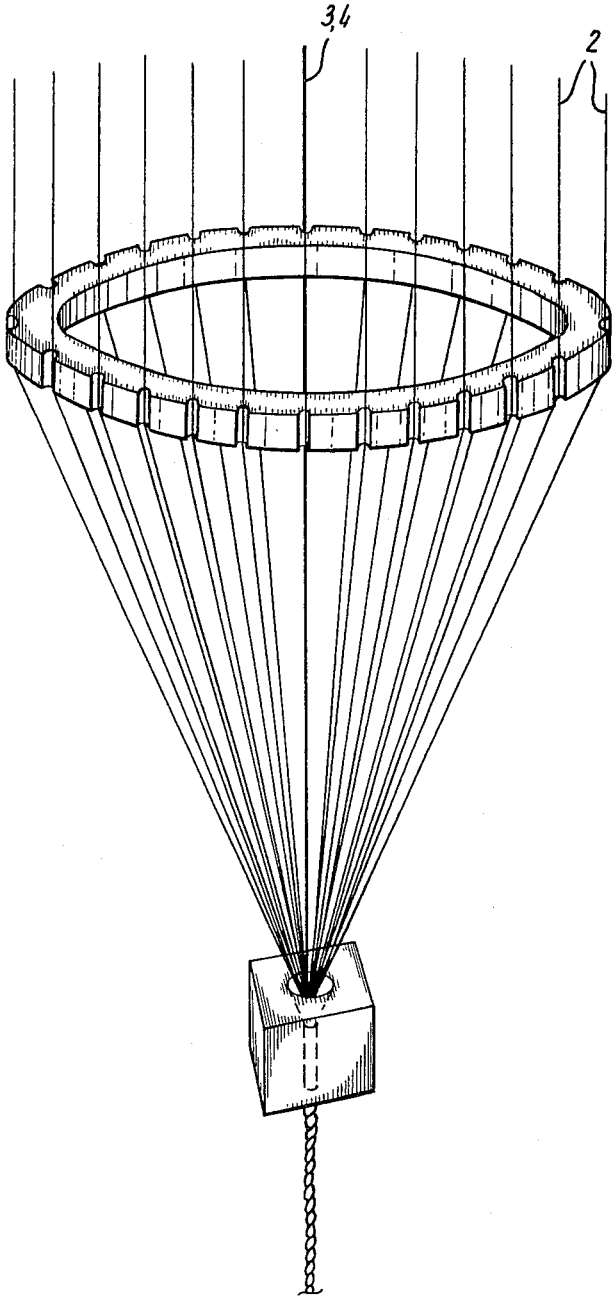
FIG. 2 shows apparatus for making a twisted bundle of filaments containing a core thread.

With reference to FIG. 2 there is shown the manufacture of a twine starting from a core thread 3, 4 and filaments 2.

With reference to FIGS. 3 and 3*a* there are shown three filament bundles or strands 10, 11 and 12 provided with a core thread 3 having a thermoplastic coating 4 which bundles are twisted together to form a line.

With reference to FIG. 4 there is shown a reticulated network consisting of interknotted cords 5, 6 and 7 in which the knots are indicated by the reference numeral 8 and 9, respectively.

The weaving or twisting of a bundle of filaments to form a braided cord or twisted rope is well known in the art. Moreover, it is also well known in the art how to produce such a cord or rope having a core of thermoplastic material. Such a braided rope is described, for example, in the aforesaid U.S. Pat. No. 2,284,728.

In accordance with the invention, this braided or twisted rope containing a core of thermoplastic material is then placed under tension and while it is kept under tension it is subjected to a heat or softening treatment to melt the thermoplastic material and cause it to penetrate into the opening between the fibers of the rope. Preferably the fibers of the rope are made of a heat shrinkable material so that as the rope is subjected to heat to melt the thermoplastic core and while the rope is under tension, the fibers shrink reducing the cross section of the rope, thereby increasing the pressure of the rope against the core and the penetration of the softened core material into the rope.

In accordance with a preferred embodiment of the invention, the thermoplastic core containing rope is first made into a net before it is heated to soften the core and shrink the fibers of the rope. In this way a net of sealed ropes, more resistant to sand penetration and abrasion than prior art nets can be obtained.

The melting temperature of the coating 4 and the shrinkage temperature of the filaments 2 should be in agreement with each other. When employing a reticulated network made of nylon 6 and constructed with a core thread made of nylon 6 surrounded by a coating of a low molecular thermoplastic material a temperature of from 50° to 90° C. is a suitable temperature to use. The temperature, however, may vary somewhat dependent on the time period and the tension applied during the treatment.

For the fixation of the knots a suitable temperature will then be 125°–135° C. likewise dependent on the time period and the tension.

The heat treatments may be carried out in a known way by means of infrared radiation, steam, hot air, boiling liquids or high frequency radio waves.

We claim:

1. A method for producing a sealed rope of braided or twisted filaments comprising forming a rope of braided or twisted, heat-shrinkable filaments about a core containing thermoplastic material, placing the rope under tension and, while under tension, treating the rope to cause the thermoplastic core material to melt while simultaneously maintaining the rope at a temperature sufficient to cause the heat-shrinkable filaments to shrink but not to melt, whereby the shrinking of the filaments, while the rope is under tension, reduces the cross section of the rope and causes the melted thermoplastic material to penetrate into the openings between and to surround and seal the filaments of the rope.

2. A method for producing a knotted netting of sealed rope of braided or twisted filaments comprising forming a rope of braided or twisted, heat-shrinkable filaments about a core containing thermoplastic material, knotting the rope to form a reticulated network of ropes, placing the knotted reticulated net under tension in all directions, and treating the net, while under tension, to cause the thermoplastic core material to melt while simultaneously heating the net to a temperature sufficient to cause the filaments to shrink but not to melt, whereby the shrinking of the filaments, while the net is under tension, reduces the cross section of the ropes of the net and causes the melted thermoplastic material to penetrate into the openings between and to surround and seal the filaments of the ropes of the net.

3. The method of claim 1 or 2 wherein the rope is heated to melt the thermoplastic material and shrink the heat-shrinkable filaments.

4. The method of claim 1 or 2 wherein the core comprises a filament that is resistant to melting or breaking at the temperatures and tension applied, coated with the thermoplastic material.

5. The method of claim 4 wherein the filament of the core is the same as the filaments of the rope.

6. The method of claim 5 wherein the filaments of the rope and the filaments of the core are of heat-shrinkable nylon and the thermoplastic coating is polyethylene and the rope, while under tension, is heated to a temperature of from 50° to 90° C. to melt the polyethylene and shrink the nylon filaments of the rope.

7. The method of claim 5 wherein the rope is a braided rope of heat-shrinkable filaments braided about the core.

8. The method of claim 5 wherein the rope is a twisted rope of a plurality of bundles of filaments, each bundle containing filaments twisted about the thermoplastic core.

9. The method of claim 4 wherein the thermoplastic material contains a coloring agent that colors the rope with the melting of the thermoplastic material.

* * * * *